United States Patent [19]

Taub

[11] Patent Number: 4,717,070

[45] Date of Patent: Jan. 5, 1988

[54] STORAGE BOX WITH LOCKING COVER

[76] Inventor: Clifford Taub, 52 Brighton Ter., Wayne, N.J. 07470

[21] Appl. No.: 31,869

[22] Filed: Mar. 30, 1987

[51] Int. Cl.[4] ..... B65D 43/02

[52] U.S. Cl. ..... 229/125.28; 229/52 B; 229/125.19

[58] Field of Search ..... 229/45 R, 52 B, 193, 229/194, 125.19, 125.28

[56] References Cited

U.S. PATENT DOCUMENTS

| | | | |
|---|---|---|---|
| 2,395,364 | 2/1946 | Williams | 229/52 B |
| 2,456,841 | 12/1948 | Rushing | 229/45 R |
| 2,551,814 | 5/1951 | Rushing et al. | 229/52 B |
| 2,809,775 | 10/1957 | White | 229/52 B |
| 2,827,222 | 3/1958 | Buttery | 229/45 R |
| 3,352,475 | 11/1967 | Centanni | 229/52 B |
| 3,369,728 | 2/1968 | Royce | 229/45 R |
| 3,734,392 | 5/1973 | Clark | 229/52 B |
| 4,139,146 | 2/1979 | Bamburg et al. | 229/194 |

*Primary Examiner*—Stephen Marcus
*Assistant Examiner*—Gary E. Elkins
*Attorney, Agent, or Firm*—Samuelson & Jacob

[57] ABSTRACT

A storage and transportation box of the type having a container body with handhold apertures includes an improved cover having side skirts which partially overlap the handhold apertures and carry locking tabs selectively receivable within the handhold apertures to lock and secure the cover in place upon the container body.

5 Claims, 8 Drawing Figures

STORAGE BOX WITH LOCKING COVER

The present invention relates generally to storage and transportation boxes and pertains, more specifically, to an improvement in a locking cover for such boxes.

The proliferation of paper documents and records of all kinds has resulted in an ever-increasing demand for storage and transportation boxes which are capable of accommodating such items with integrity as well as with economy. Among the more popular boxes of that type are those constructed of corrugated paper board and supplied in blank, or knock-down, configuration for inventory and subsequent erection on the site as required.

A wide variety of these boxes currently is available. Many share a similar construction which includes a container body with side walls extending upwardly from a closed bottom and handhold apertures in opposite side walls. A cover telescopes over the side walls to close the container. Some boxes include a locking arrangement for securing the cover in place over the container body. The present invention provides an improved locking arrangement for securing a cover in place over a container body in a storage and transporation box of the type described.

Among the objects and advantages of the present invention in providing an improved locking arrangement for the cover of a storage and transporation box of the type described are: The attainment of a simplified locking arrangement with only a minimal departure from conventional construction so as to enable widespread use of the improvement without requiring significant changes in manufacturing tools or techniques, and without any changes in the overall dimensions or shape of the boxes themselves; ease of incorporation into currently available box constructions; ease of use, in both the selective locking or unlocking of the locking arrangement during closing or opening of the box; enhancement of the ability to grip and carry the box with the cover secured in place; positive securement of the locking arrangement against inadvertent release, while enabling ease of selective release; increased strength and load-bearing capabilities in the various component parts; and economical manufacture in large quantities of consistent high quality.

The above objects, as well as still further objects and advantages are attained by the present invention which may be described briefly as providing an improvement in a storage and transportation box of the type having a container body with side walls extending upwardly from a closed bottom to an open top and at least one handhold aperture located in a side wall, adjacent to and spaced downwardly from the open top, the handhold aperture having laterally spaced apart opposite end boundaries defining opposite ends and laterally extending upper and lower boundaries, and a cover for placement over the open top of the container body so as to close the top, the cover including a top wall and depending skirts integral with the top wall for juxtaposition with corresponding side walls of the container body in a generally telescoping relationship, the skirts having lowermost edges spaced downwardly from the top wall, wherein the lowermost edge of at least the skirt corresponding to the side wall with the handhold aperture is spaced downwardly relative to the downward spacing of the handhold aperture to locate the lowermost edge in a position extending laterally across the handhold aperture, between the upper and lower boundaries thereof, a slit in the skirt extending upwardly from the lowermost edge toward the top wall adjacent each end of the handhold aperture, and a fold-line extending laterally between the slits, adjacent the uppermost boundary of the handhold aperture, such that the slits and the fold-line define a locking tab receivable within the handhold aperture, upon folding of the locking tab inwardly along the fold-line and through the handhold aperture, to secure the cover against upward movement relative to the container body. The cover is erected from a blank of foldable material, such as corrugated paper board, the blank including a top section having laterally spaced apart opposite sides and longitudinally spaced apart opposite ends for forming the top wall, side sections at each side of the top section for forming opposite side skirts, and end sections at each of the opposite ends for forming opposite end skirts, the end sections each having two skirt portions and a laterally extending lowermost edge fold-line located between the two skirt portions and extending between the opposite sides, the laterally extending lowermost edge fold-line defining the lowermost edge of the end skirt when the end skirt portions are folded into juxtaposition with one another along the lowermost edge fold-line, the slits extending transverse to the lowermost edge fold-line in opposite directions away from the lower most edge fold-line such that the locking tabe includes a locking tab portion in each of the end skirt portions, the locking tab portions being folded into juxtaposition with one another when the end skirt portions are folded into juxtaposition with one another.

The invention will be understood more fully, while still further objects and advantages will become apparent in the following detailed description of a preferred embodiment illustrated in the accompanying drawing, in which.

Figure 1:
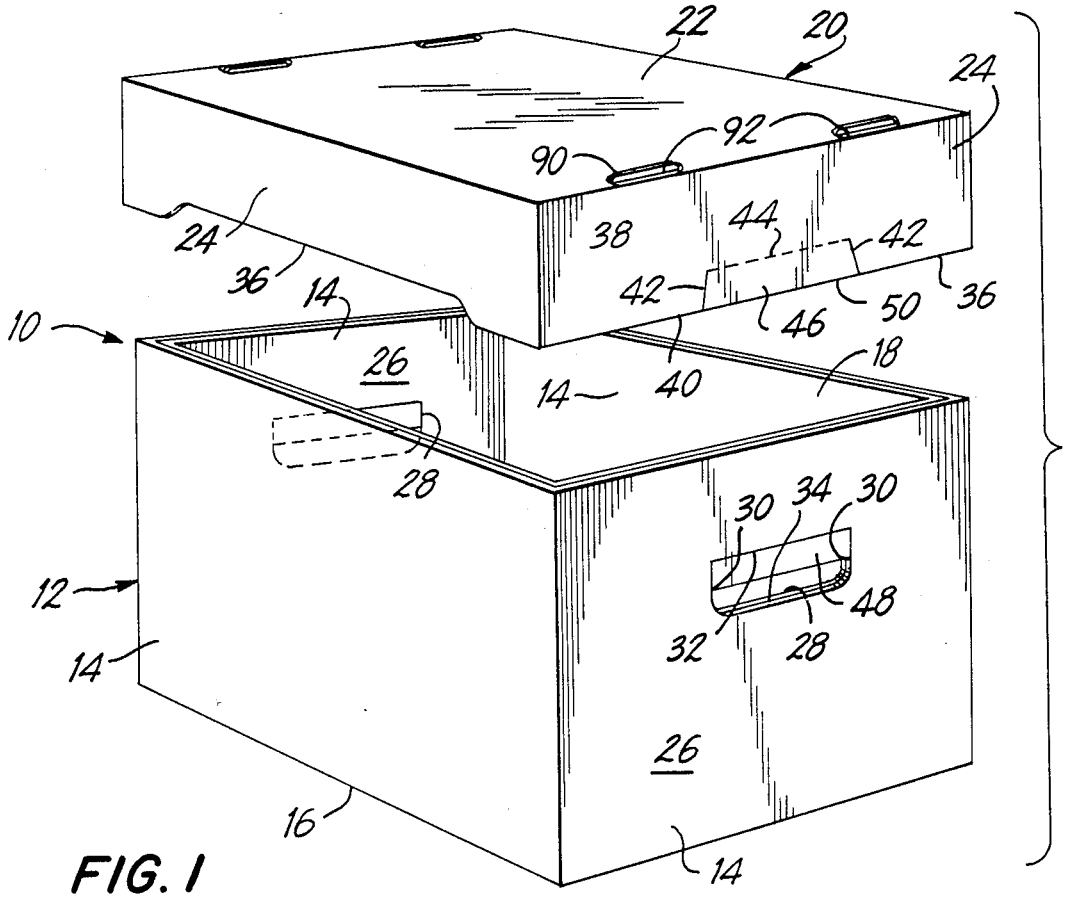
FIG. 1 is an exploded perspective view of a box having a locking cover constructed in accordance with the present invention.

Referring now to the drawing, and especially to FIG. 1 thereof, a storage and transportation box is illustrated at 10 and is seen to have a container body 12 with side walls 14 extending upwardly from a closed bottom 16 to an open top 18. A cover 20, constructed in accordance with the present invention, includes a top wall 22 and side skirts 24 depending from the top wall 22 for juxtaposition with corresponding side walls 14 of the container body 12 in a generally telescoping relationship to close the container body 12 in a conventional manner. One pair of opposite side walls 14, here designated as end walls 26, includes a handhold aperture 28 in each end wall 26, spaced downwardly from the open top 18, for enabling gripping of the box 10 for lifting and carrying, in a now-conventional manner. Each handhold aperture 28 has laterally spaced apart end boundaries 30 and laterally extending upper and lower boundaries 32 and 34, respectively.

Figure 2:
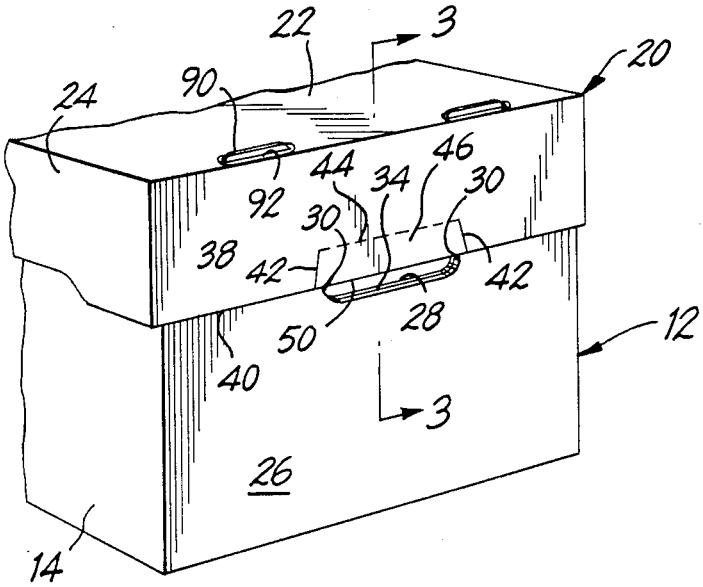
FIG. 2 is a fragmentary perspective view showing a portion of the box with the cover in place.
Figure 3:
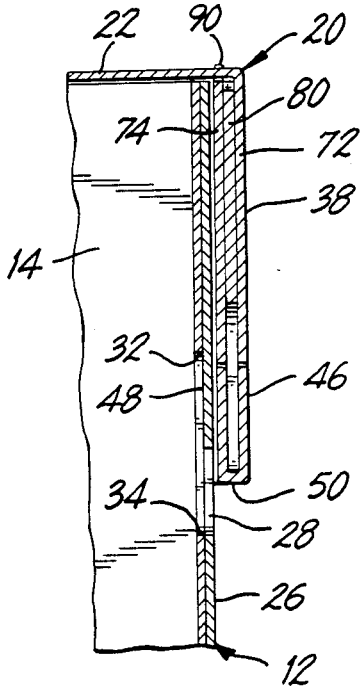
FIG. 3 is an enlarged cross-sectional view taken along line 3—3 of FIG. 2.

Turning to FIGS. 2 and 3, cover 20 is telescoped over container body 12 to close the box 10. The side skirts 24 each have lowermost edges 36 spaced downwardly from top wall 22 so that the skirts 24 overlap corresponding side walls 14 of the container body 12. The pair of opposite side skirts 24 which correspond to end walls 26 are designated herein as end skirts 38 and the lowermost edge 36 of each end skirt 38, designated as edge 40, is spaced downwardly relative to the handhold aperture 28 in the end wall 26 so that the lowermost edge 40 is located in a position to extend laterally across the handhold aperture 28, between the upper and lower boundaries 32 and 34 of the handhold aperture 28.

A pair of slits 42 in each end skirt 38 extend upwardly from the lowermost edge 36 toward the top wall 22, adjacent each end of the handhold aperture 28, and a fold-line 44 extends laterally between the slits 42, adjacent the upper boundary 32 of the handhold aperture 28, such that the slits 42 and the fold-line 44 define a locking tab 46 which overlaps at least a portion of the handhold aperture 28.

Figure 4:
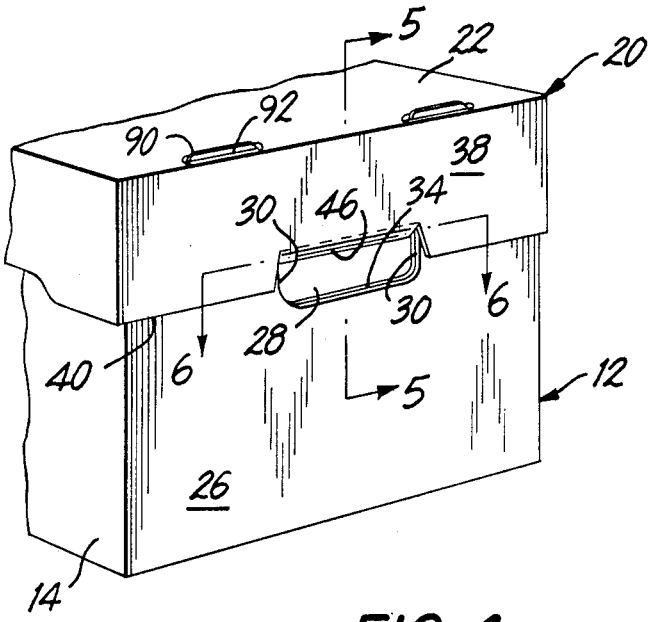
FIG. 4 is a fragmentary perspective view similar to FIG. 2, but with the locking arrangement in locked position.
Figure 5:
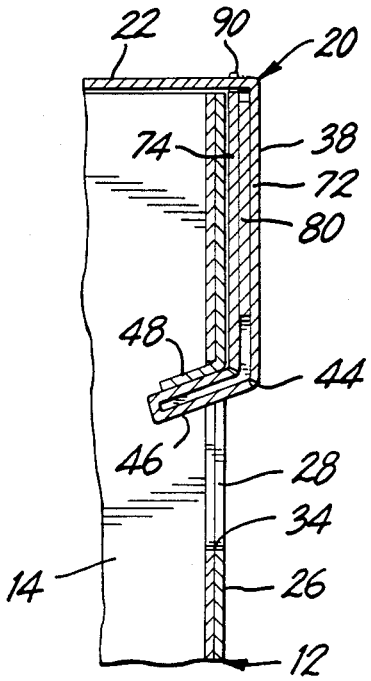
FIG. 5 is an enlarged cross-sectional view taken along line 5—5 of FIG. 4.
Figure 6:
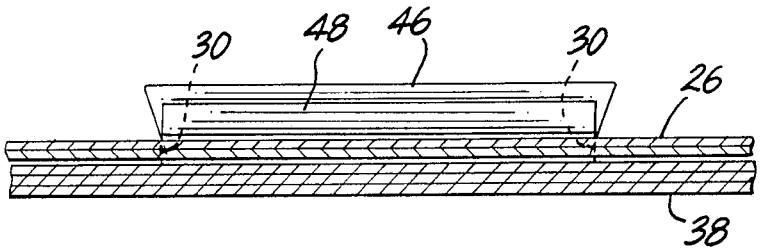
FIG. 6 is an enlarged cross-sectional view taken along line 6—6 of FIG. 4.

As best seen in FIGS. 4, 5 and 6, locking tab 46 is selectively folded inwardly along fold-line 44 to be received within handhold aperture 28 so as to secure cover 20 against release from container body 12 when the cover 20 is in proper position to close top 18. Thus, simultaneous with the gripping of the box 10 by the placement of an operator's hand within handhold aperture 28, locking tab 46 is folded inwardly through handhold aperture 28 to secure the cover 20 in place. At the same time, a flap 48, which is unitary with end wall 26, is folded inwardly to serve as a reinforcement for gripping along the upper boundary 32 of the handhold aperture 28.

Fold-line 44 has a length which is generally coextensive with the length of the upper boundary 32 of the handhold aperture 28, between the opposite end boundaries 30, and the slits 42 extend in directions angled outwardly away from one another between the fold-line 44 and lowermost edge 40 of the end skirt 38 such that the lowermost edge 50 of the locking tab 46 has a length greater than the length of the handhold aperture 28 between the opposite end boundaries 30. Thus, the locking tab 46 is provided with a dove-tail configuration which wedges the locking tab 46 in place between the end boundaries 30 of the handhold aperture 28 and prevents inadvertent withdrawal of the locking tab 46 from the handhold aperture 28. The resilience of the material of cover 20 enables insertion of the locking tabs 46 into locking engagement with the handhold apertures 28. Likewise, the resilience of the material of locking tab 46 enables selective release of the locking tabs 46 from handhold apertures 28 whenever it is desired to remove cover 20 from container body 12. The arrangement whereby the locking tabs 46 only partially overlap the handhold apertures 28 enables an operator to reach in and withdraw a locking tab 46 from a handhold aperture 28 at will. In this manner, the conventional arrangement of handhold apertures 28 within the container body 12 serves the added function of accommodating the locking mechanism provided by locking tab 46 of the improved cover 20. In addition, locking tabs 46 provide an increased area, when inserted within handhold apertures 28, for gripping to lift the assembled box 10.

Figure 7:
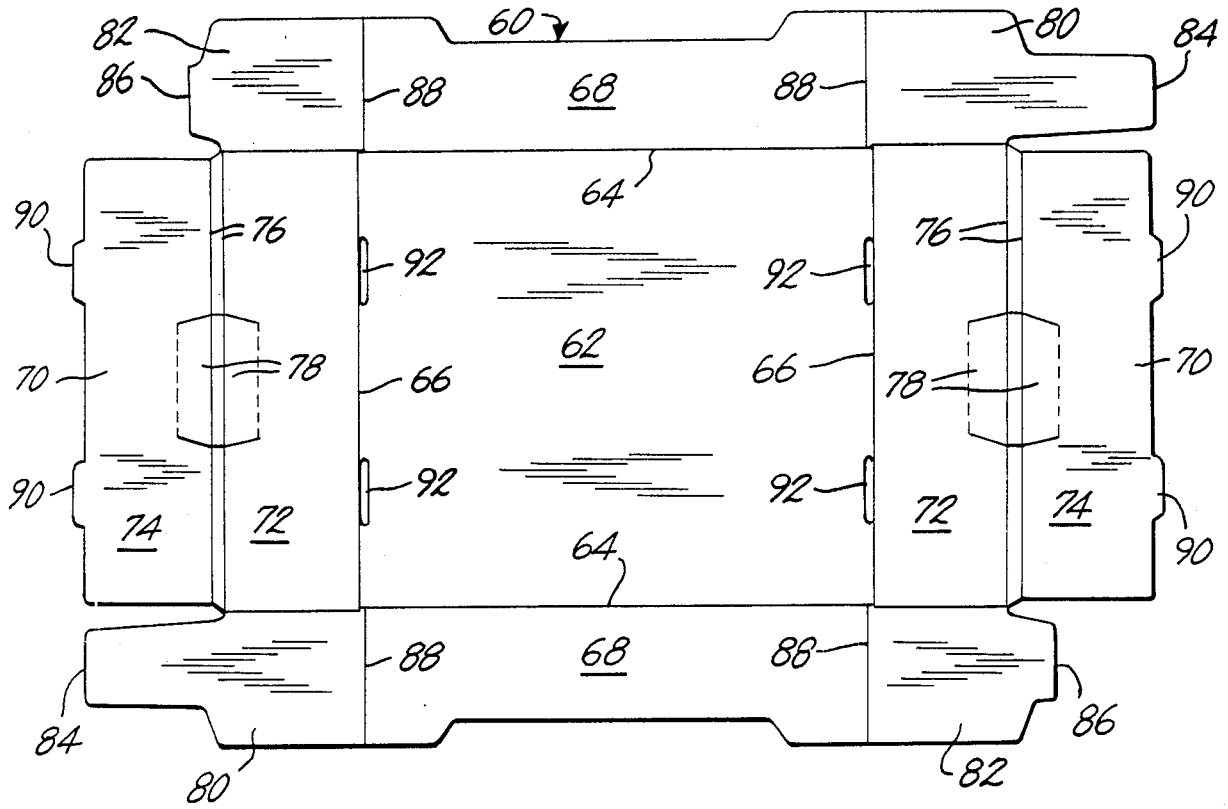
FIG. 7 is a plan view of a cover blank for erecting the cover of the box.
Figure 8:
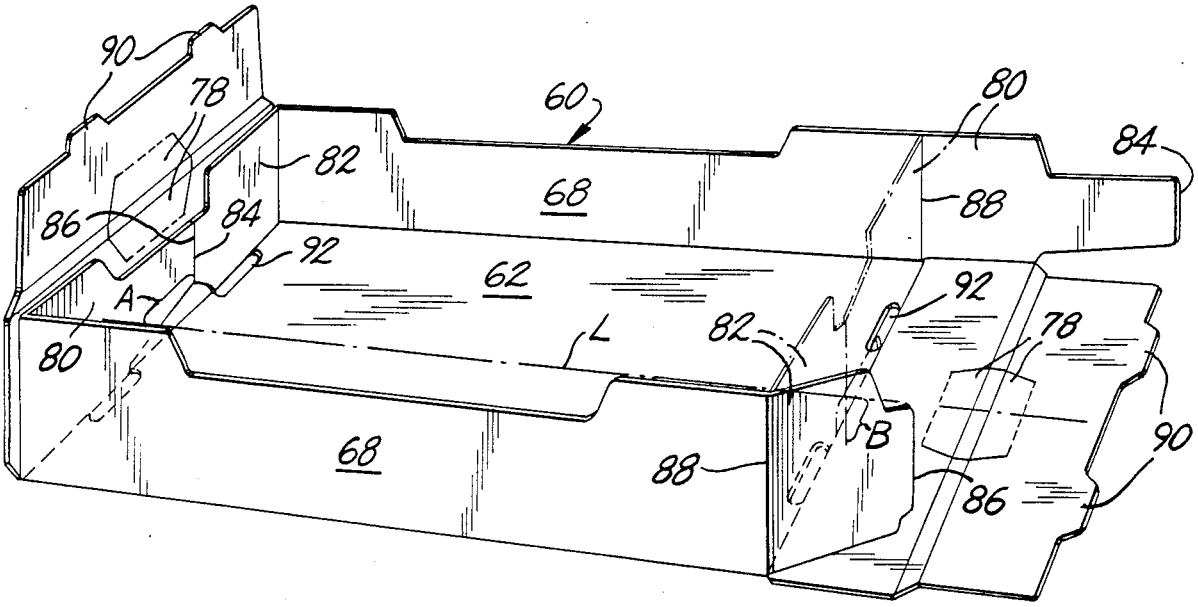
FIG. 8 is a perspective view of the cover blank, partially erected.

Referring now to FIGS. 7 and 8, cover 20 preferably is erected from a flat blank 60 cut from a sheet of corrugated paper board. Blank 60 has a top section 62 with laterally spaced apart opposite sides 64 and longitudinally spaced apart opposite ends 66, all defining what will become top wall 22. Side sections 68 will become side skirts 24 when folded along sides 64. End sections 70 will be folded to establish end skirts 38, and each end section 70 includes two skirt portions 72 and 74 and laterally extending lowermost edge fold-lines 76 located between the skirt portions 72 and 74 and extending between the opposite sides 64 for defining the lowermost edge 40 of the corresponding end skirt 38 when the end skirt portions 72 and 74 are folded into juxtaposition with one another along the lowermost edge fold-lines 76.

Each of the skirt portions 72 and 74 includes a pair of slits 42 and a fold-line 44 so that when the skirt portions 72 and 74 are folded into a double-walled end skirt 38, a double-walled locking tab 46 will become available. The double-walled locking tab 46 provides added strength in comparison to known locking arrangements of single-walled construction. Thus, the slits 42 extend transverse to the lowermost edge fold-lines 76 in opposite directions away from the fold-lines 76 such that the locking tab 46 will be established from a locking tab portion 78 in each end skirt portion 72 and 74 when the end skirt portions 72 and 74 are folded into juxtaposition with one another. The slits 42 in each of the skirt portions 72 and 74 converge toward one another in the direction away from fold-lines 76 such that upon erection of the cover 20, the locking tab 46 will have the desired dove-tail configuration.

Blank 60 includes end skirt flaps 80 and 82 integral with corresponding side skirt sections 68 at the longitudinal ends of the side skirt sections 68. The end skirt flaps 80 and 82 have respective terminal end edges 84 and 86 and are foldable along fold-lines 88 so that the end skirt flaps 80 and 82 will be placed between the skirt portions 72 and 74 and the end edges 84 and 86 will confront one another in the erected cover 20. Thus, end skirt flaps 80 and 82 will be folded along fold-lines 88, as seen in FIG. 8, and end skirt portions 72 and 74 will be folded around end skirt flaps 80 and 82 until tabs 90 on end skirt portions 74 enter corresponding slots 92 to secure all of the portions of blank 60 into erected cover 20. End skirt flap 80 is longer than end skirt flap 82 so that the terminal end edges 84 and 86 confront one another at a location offset laterally relative to longitudinal centerline L and locking tab 46 and, ultimately, handhold aperture 28, as illustrated by lateral offset A. In this manner, any load imposed upon the end skirt flaps during locking of the cover 20 to the container body 12 and lifting at the handhold apertures 28 is borne by an uninterrupted portion of end skirt flap 80. Thus, any tendency toward buckling of the end skirt 38 adjacent the center of the handhold aperture 28 is resisted by the integrity of end skirt flap 80. As an added strength measure, the lateral offset of the abutting terminal edges 84 and 86 at one end skirt 38, as shown by lateral offset A, is located laterally opposite the centerline L from the lateral offset B of the abutting terminal edges 84 and 86 of the other end skirt 38 so as to distribute the load diagonally along the cover 20, rather than longitudinally directly along the the cover 20.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. In a storage and transportation box of the type having a container body with side walls extending upwardly from a closed bottom to an open top and at least one handhold aperture located in a side wall, adjacent to and spaced downwardly from the open top, the handhold aperture having laterally spaced apart opposite end boundaries defining opposite ends and laterally extending upper and lower boundaries, and a cover for placement over the open top of the container body so as to close the top, the cover including a top wall and depending skirts integral with the top wall for juxtaposition with corresponding side walls of the container body in a generally telescoping relationship, the skirts having lowermost edges spaced downwardly from the top wall, the improvement wherein:

the lowermost edge of at least the skirt corresponding to the side wall with the handhold aperture is spaced downwardly relative to the downward spacing of the handhold aperture to locate said lowermost edge in a position extending laterally across the handhold aperture, between the upper and lower boundaries thereof, a slit in the skirt extending upwardly from the lowermost edge toward the top wall adjacent each end of the handhold aperture, and a fold-line extending laterally between the slits, adacent the uppermost boundary of the handhold aperture, such that the slits and the fold-line defined a locking tab receivable within the handhold aperture, upon folding of the locking tab inwardly along the fold-line and through the handhold aperture, to secure the cover against upward movement relative to the container body; and the cover is erected from a blank of foldable material, such as corrugated paper board, the blank including a top section having laterally space apart opposite sides and longitudinally spaced apart opposite ends for forming the top wall, side sections at each side of the top section for forming opposite side skirts, and end sections at each of the opposite ends for forming opposite end skirts, the end sections each having two skirt portions and a laterally extending lowermost edge fold-line located between the two skirt portions and extending between the opposite sides, said laterally extending lowermost edge fold-line defining the lowermoset edge of the end skirt when the end skirt portions are folded into juxtaposition with one another along the lowermost edge fold-line, said slits extending transverse to the lowermost edge fold-line in opposite directions away from the lowermost edge fold-line such that the locking tab includes a locking tab portion in each of the end skirt portions, the locking tab portions being folded into juxtaposition with one another when the end skirt portions are folded into juxtaposition with one another.

2. The invention of claim 1 wherein the slits in each end skirt portion converge toward one another in the direction away from the lowermost edge fold-line such that upon erection of the cover the locking tab is provided with a dove-tail configuration.

3. The invention of claim 1 including end skirt flaps integral with each side skirt section at the longitudinal ends of the side skirt sections, the end skirt flaps having terminal end edges and being foldable for extending between the end skirt portions of a corresponding end skirt when said end skirt portions are folded along said lowermost edge fold-line into juxtaposition with one another such that the end skirt flaps confront one another at the terminal end edges thereof, one of said end skirt flaps being longer than the other of said end skirt flaps so that the terminal end edges confront one another at a location offset laterally relative to the locking tab.

4. The invention of claim 3 wherein the end skirt flaps of one of said opposite end skirts confront one another at a first location offset laterally in a first lateral direction relative to the locking tab and the end skirt flaps of the other of said opposite end skirts confront one another at a second location offset lateraly in a second lateral direction relative to the locking tab, the second lateral direction being opposite to the first lateral direction.

5. The invention of claim 3 the slits in each end skirt portion converge toward one another in the direction away from the lowermost edge fold-line such that upon erection of the cover the locking tab is provided with a dove-tail configuration.

* * * * *